US008069594B2

(12) United States Patent
Tsai

(10) Patent No.: US 8,069,594 B2
(45) Date of Patent: Dec. 6, 2011

(54) CLAMPING PIECE STRUCTURE

(76) Inventor: Chin-Yuan Tsai, Tainan (TW)

( * ) Notice: Subject to any disclaimer, the term of this patent is extended or adjusted under 35 U.S.C. 154(b) by 18 days.

(21) Appl. No.: 12/810,513

(22) PCT Filed: Jan. 24, 2008

(86) PCT No.: PCT/CN2008/070177

§ 371 (c)(1),
(2), (4) Date: Jun. 25, 2010

(87) PCT Pub. No.: WO2009/094858

PCT Pub. Date: Aug. 6, 2009

(65) Prior Publication Data

US 2010/0281720 A1 Nov. 11, 2010

(51) Int. Cl.
*G09F 1/00* (2006.01)

(52) U.S. Cl. ..... 40/124.13; 40/124.09; 40/124.12

(58) Field of Classification Search ..... 40/124.13, 40/124.01, 124.09, 124.12
See application file for complete search history.

(56) References Cited

U.S. PATENT DOCUMENTS 2,203,578 A * 6/1940 Podmore ..... 40/124.09
4,046,368 A * 9/1977 LeBreton ..... 493/356
5,822,896 A * 10/1998 Milstein ..... 40/124.07

FOREIGN PATENT DOCUMENTS

WO WO 2005029448 A2 * 3/2005

* cited by examiner

*Primary Examiner* — Gary Hoge

(57) ABSTRACT

A clamping piece structure includes a one-piece clamping piece body (10). The body (10) includes a first folding piece portion (11), a second folding piece portion (12), a third folding piece portion (13), and a connecting piece portion (14). A first bending portion (15) is provided at a central section of an edge of the first folding piece portion (11) for interconnection with the connecting piece portion (14). A second bending portion (16) is provided at the other edge of the first folding piece portion (11) for interconnection with the second folding piece portion (12). A third bending portion (17) is provided at an edge of the second folding piece portion (12) for interconnection with the third folding piece portion (13). An engagement section (141) is provided at an outer edge of the connecting piece portion (14). An opening (121) is formed in a central section of the second folding piece portion (12). The connecting piece portion (14) is insertable through the opening (121). Thus, the connecting piece portion (14) can be inserted through the opening (121), and the engagement section (141) at the end of the connecting piece portion (14) can be engaged with the third folding piece portion (13). The structure can easily be assembled with reliable effect.

3 Claims, 13 Drawing Sheets

CLAMPING PIECE STRUCTURE

FIELD OF THE INVENTION

The present invention relates to a clamping piece structure and, more particularly, to a clamping piece structure that can be folded in differing directions to present differing styles.

BACKGROUND OF THE INVENTION

Conventional clamping pieces can be folded or unfolded and can include figures that can be seen when the clamping pieces are unfolded. Examples of the clamping pieces include invitations and menus that can be unfolded to show the figures (drawings or texts) on inner faces thereof. The clamping pieces can also be utilized to clip objects.

However, the above clamping pieces, when unfolded, can only exhibit figures in a fixed manner, which is monotonous. To avoid the above disadvantage, the applicant designed a clamping piece structure disclosed in Taiwan Patent Application No. 095127913. As shown in, FIGS. 11 and 12, the clamping piece structure includes two clamping bodies 1' and 2' and three connecting strips 31', 32', and 33'. When clamping bodies 1' and 2' are unfolded, two ends 311' and 312' of the connecting strip 31' are engaged with a central section of an outer edge 11' of the clamping body 1' and a central section of an inner edge 22' of the clamping body 2'. An end 321', 331' and the other end 322', 332' of each of the connecting strips 32' and 33' are respectively engaged with an outer edge 21' of the clamping body 2' and an inner edge 12' of the clamping body 1'. The end 312' of the connecting strip 31' is intermediate the connecting strips 32' and 33'. The engagement mentioned above can be achieved by bonding, sewing, etc. After assembly, the two clamping bodies 1' and 2' can be coupled or unfolded. Furthermore, the two clamping bodies 1' and 2' can be turned in different directions (indicated by arrows X and Y) to present differing styles, as shown in FIG. 13.

However, the above structure requires connection of two clamping bodies 1' and 2' with three connecting strips 31', 32' and 33', leading to inconvenient assembly. Furthermore, after assembly, the whole clamping piece will be damaged and, thus, can not be used if any one of the connecting strips is not firmly engaged. Further, the assembling stability and assembling reliability are poor. Further, figures must be provided on front and rear faces of the connecting strips 31', 32', and 33' to present obvious visual effects, leading to inconvenience in provision of the figures.

BRIEF SUMMARY OF THE INVENTION

An objective of the present invention is to provide a one-piece clamping piece structure that can be turned in differing directions to show different figures for different visual effects while providing convenient, stable, and reliable assembly.

Thus, the present invention adopts an option as follows:

A clamping piece structure includes a one-piece clamping piece body. The body includes a first folding piece portion, a second folding piece portion, a third folding piece portion, and a connecting piece portion. The first, second, and third folding piece portions have substantially the same width. A first bending portion is provided at a central section of an edge of the first folding piece portion for interconnection with the connecting piece portion. A second bending portion is provided at the other edge of the first folding piece portion for interconnection with the second folding piece portion. A third bending portion is provided at an edge of the second folding piece portion for interconnection with the third folding piece portion. The connecting piece portion includes a main section having a width approximately the same as the width of the first, second, and third folding piece portions. An engagement section is provided at an outer edge of the connecting piece portion. An opening is formed in a central section of the second folding piece portion. The connecting piece portion is insertable through the opening.

The engagement section extends along the outer edge of the connecting piece portion. A fourth bending portion is provided between the engagement section and the main section of the connecting piece portion. The engagement section of the connecting piece portion is engaged with a rear face of the third folding piece portion.

The engagement section of the connecting piece portion is engaged with the rear face of the third folding piece portion by bonding.

The connecting piece portion is engaged with the rear face of the third folding piece portion by male/female coupling.

A face of each of the first, second, and third folding piece portions includes figures.

A first figure section is provided in a central section of a rear face of the first folding piece portion aligned with the connecting piece portion in a horizontal direction, in upper and lower sections of a front face of the second folding piece portion respectively above and below the opening, in upper and lower sections of a front face of the third folding piece portion respectively above and below a section of the third folding piece portion aligned with the connecting piece portion in the horizontal direction, and on a rear face of the connecting piece portion. Furthermore, a second figure section is provided in upper and lower sections of the rear face of the first folding piece portion respectively above and below the central section aligned with the connecting piece portion in the horizontal direction, in upper and lower sections of a rear face of the second folding piece portion respectively above and below the opening, in the central section of the front face of the third folding piece portion aligned with the connecting piece portion in the horizontal direction, and on the front face of the connecting piece portion.

Thus, in assembly of the present invention, the second and third bending portions are bent in opposite directions, and the first bending portion is bent to make the connecting piece portion insert through the opening of the second folding piece portion. The engagement section at the end of the connecting piece portion is engaged with the rear face of the third folding piece portion by bonding or other suitable provisions. After assembly, the first figure portions can be exhibited when the third bending portion is unfolded. Furthermore, the second figure portions can be exhibited when the second bending portion is unfolded. In this case, the engagement section of the connecting piece portion is at a center of the body. Furthermore, objects can be clamped between the second and third folding piece portions and between the first folding piece portion and the connecting piece portion. Thus, the present invention can be turned in differing directions to show different figures or to clamp objects for different visual effects. Furthermore, the present invention is integrally formed to reduce the number of components while providing enhanced assembling convenience and enhanced convenience in figure provision as well as enhanced stability for the product after assembly.

REFERENCE NUMERALS

| | | | |
|---|---|---|---|
| 10 body | 11 first folding piece portion | 12 second folding piece portion | |
| 121 opening | 13 third folding piece portion | 14 connecting piece portion | |
| 141 engagement section | 142 fourth bending portion | 15 first bending portion | |
| 16 second bending portion | 17 third bending portion | | |
| 2 object | A1-A6 first figure section | B1-B6 second figure section | |
| 1' clamping body | 11' outer edge | 12' inner edge | |
| 2' clamping body | 21' outer edge | 22' inner edge | 31' connecting strip |
| 311', 312' end | 32' connecting strip, | 321', 322' end | |
| 33' connecting strip | 331', 332' end | | |

DETAILED DESCRIPTION OF THE INVENTION

Figure 1:
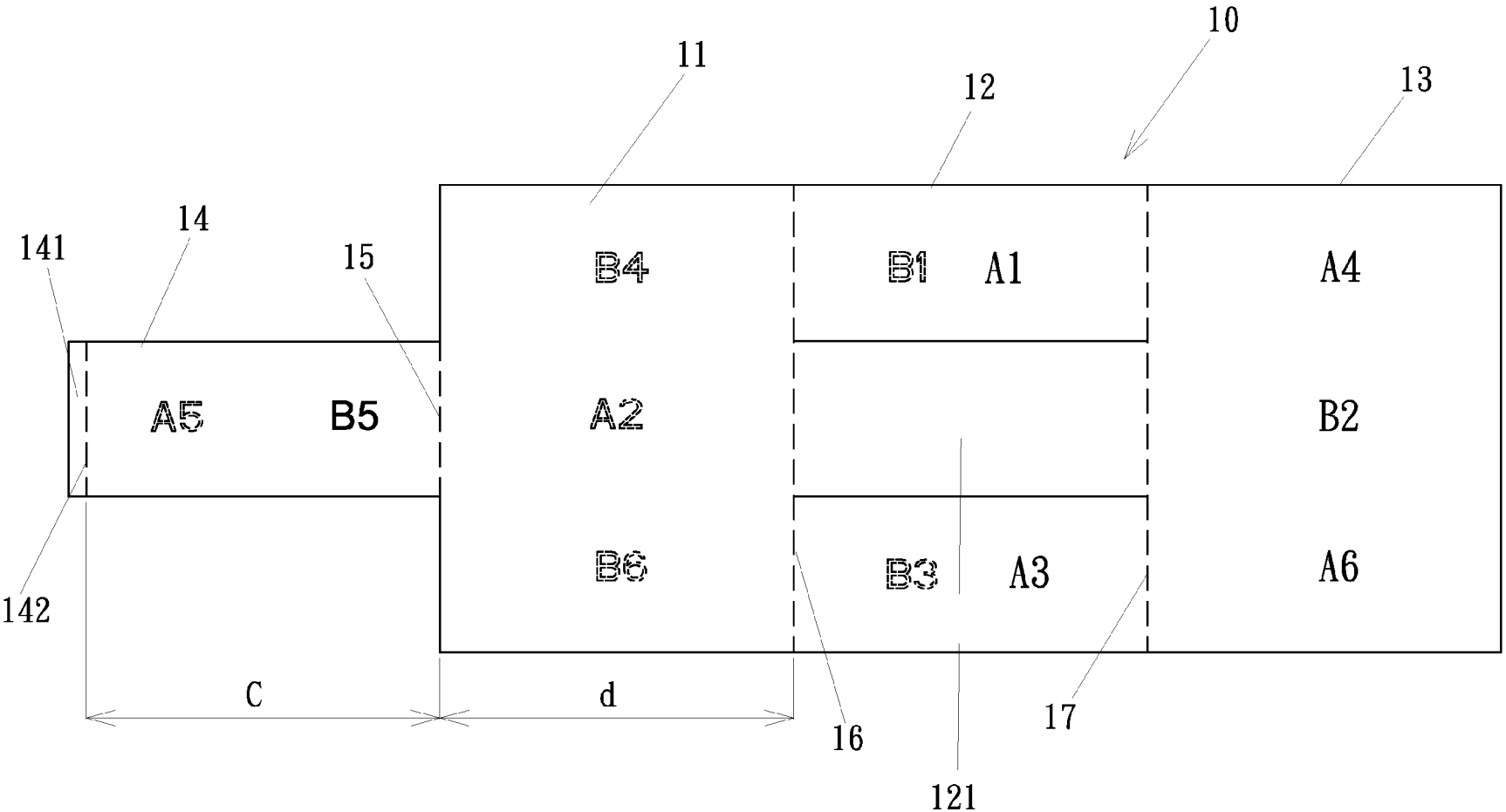
FIG. 1 shows a schematic view of a clamping piece of the present invention in an unfolded state.

With reference to FIG. 1, the present invention is mainly a one-piece clamping piece body 10. The body 10 can be made of paper, plastic, or other bendable material and includes a first folding piece portion 11, a second folding piece portion 12, a third folding piece portion 13, and a connecting piece portion 14. The first, second, and third folding piece portions 11, 12, and 13 have substantially the same width. A first bending portion 15 is provided at a central section of an edge of the first folding piece portion 11 for interconnection with the connecting piece portion 14. A second bending portion 16 is provided at the other edge of the first folding piece portion 11 for interconnection with the second folding piece portion 12. A third bending portion 17 is provided at an edge of the second folding piece portion 12 for interconnection with the third folding piece portion 13. The connecting piece portion 14 includes a main section having a width c approximately the same as the width d of the first folding piece portion 11. An engagement section 141 is provided at an outer edge of the connecting piece portion 14. A fourth bending portion 142 is provided between the engagement section 14 and the main section of the connecting piece portion 14. An opening 121 is formed in a central section of the second folding piece portion 12. The connecting piece portion 14 is insertable through the opening 121.

Figures such as drawings or texts can be provided on the faces of the first, second, and third folding piece portions 11, 12 and 13 and the connecting piece portion 14 of the present invention. A first figure section A1-A6 is provided in a central section of a rear face of the first folding piece portion 11 aligned with the connecting piece portion 14 in a horizontal direction, in upper and lower sections of a front face of the second folding piece portion 12 respectively above and below the opening 121, in upper and lower sections of a front face of the third folding piece portion 13 respectively above and below a section of the third folding piece portion 13 aligned with the connecting piece portion 14 in the horizontal direction, and on a rear face of the connecting piece portion 14. In the drawings, A1, A3, A4, and A6 are figure portions on the front faces, and A2 and A5 shown in phantom lines are figure portions on the rear faces.

Furthermore, a second figure section B1-B6 is provided in upper and lower sections of the rear face of the first folding piece portion 11 respectively above and below the central section aligned with the connecting piece portion 14 in the horizontal direction, in upper and lower sections of a rear face of the second folding piece portion 12 respectively above and below the opening 121, in the central section of the front face of the third folding piece portion 13 aligned with the connecting piece portion 14 in the horizontal direction, and on the front face of the connecting piece portion 14. In the drawings, B1, B3, B4, and B6 are figure portions on the front faces, and B2 and B5 shown in phantom lines are figure portions on the rear faces.

Figure 2:
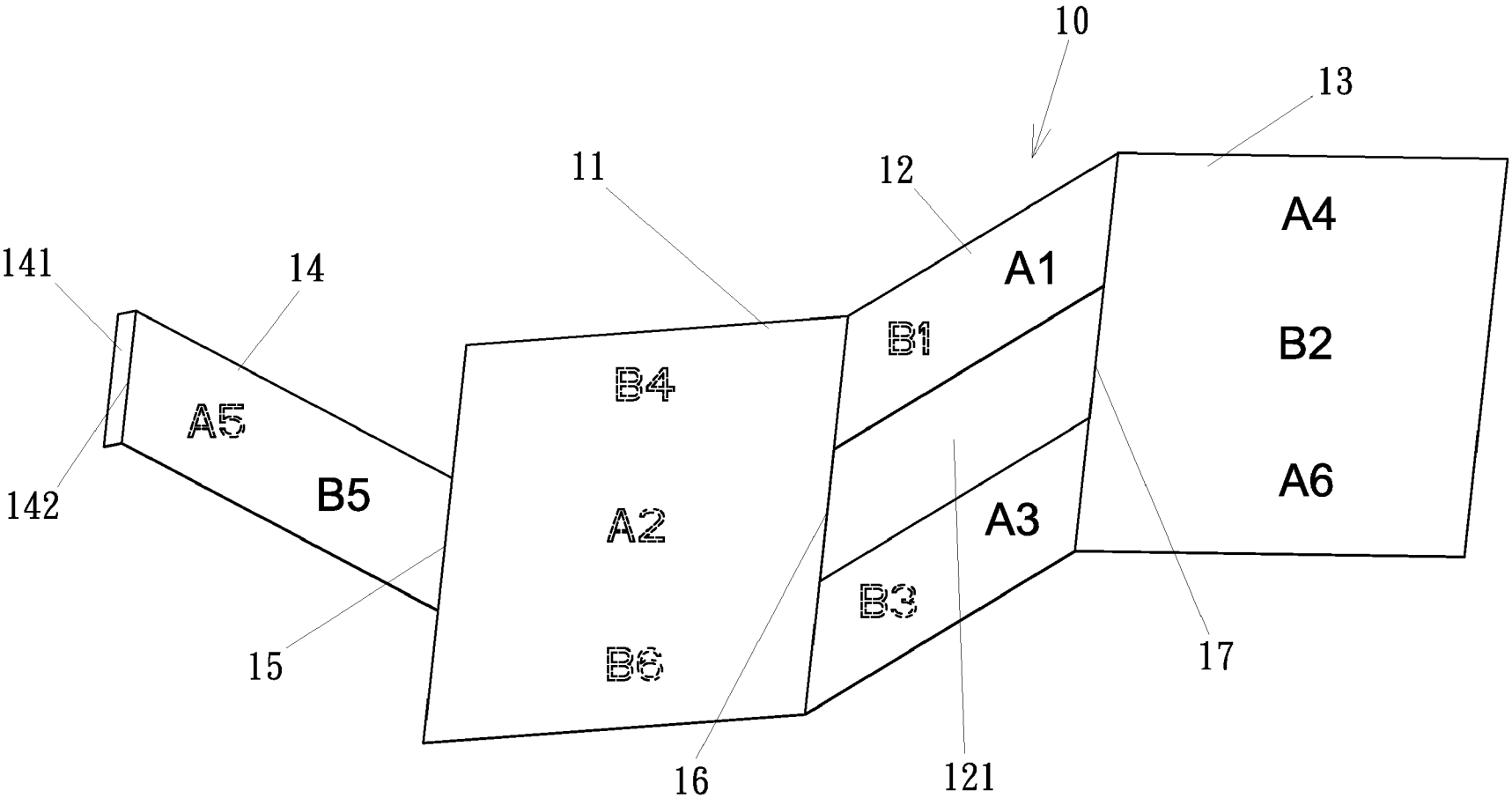
FIG. 2 shows a perspective view illustrating folding of the clamping piece of the present invention.
Figure 3:
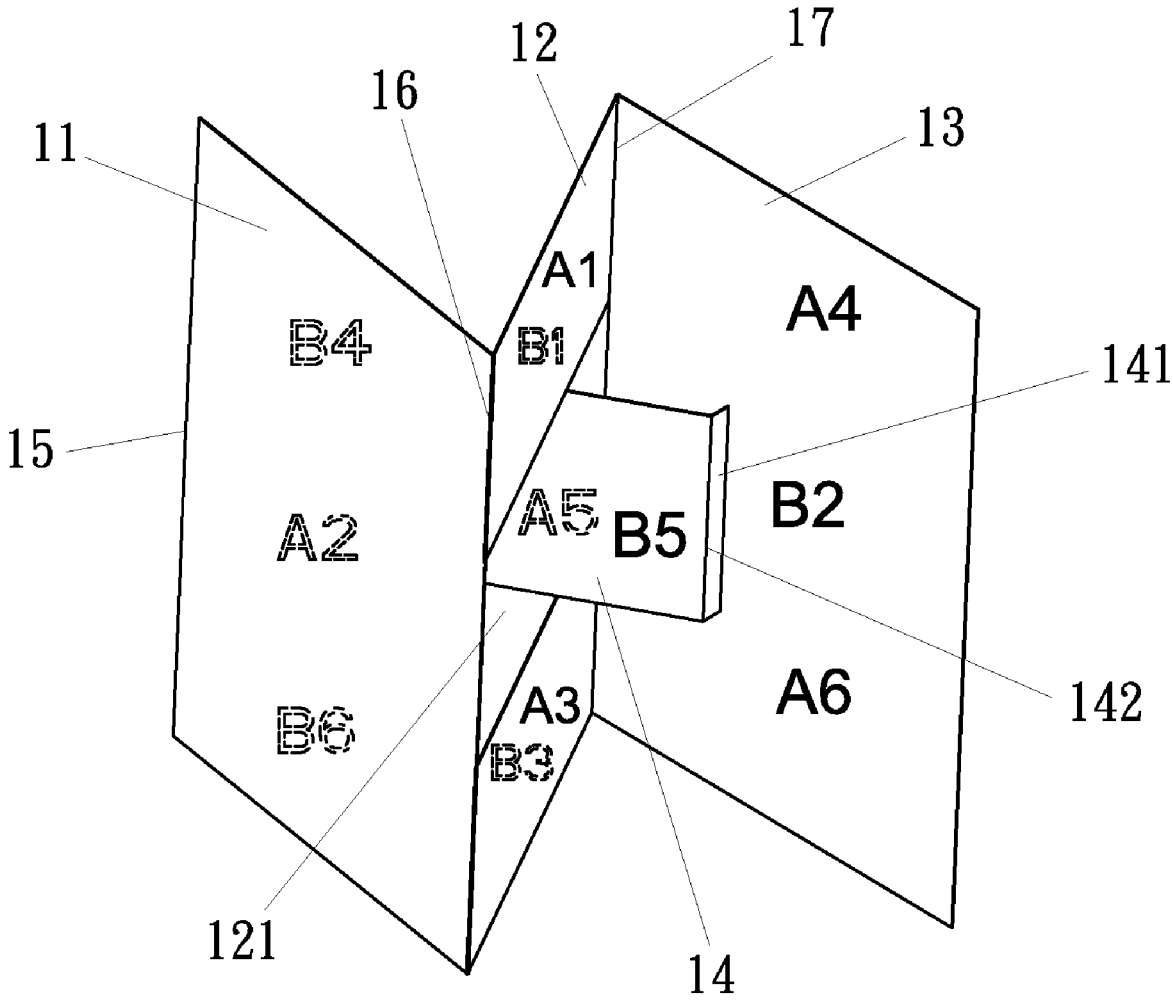
FIG. 3 shows another perspective view illustrating folding of the clamping piece of the present invention.

With reference to FIGS. 1-3, in assembly of the present invention, the second and third bending portions 16 and 17 are bent in opposite directions, and the first bending portion 15 is bent to make the connecting piece portion 14 insert through the opening 121 of the second folding piece portion 12. The engagement section 141 at the end of the connecting piece portion 14 is engaged with the rear face of the third folding piece portion 13 by bonding or other suitable provisions.

Figure 4:
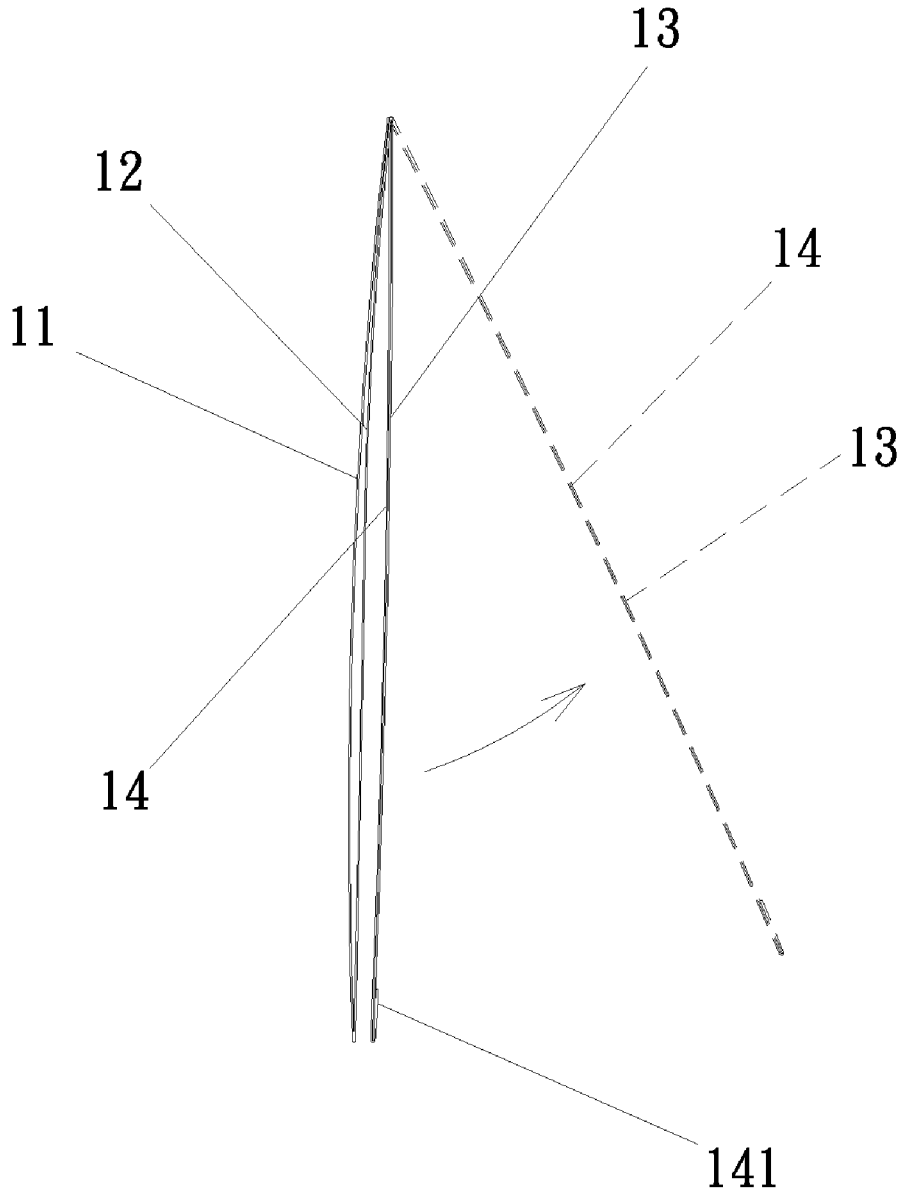
FIG. 4 shows a side view of the clamping piece of the present invention in a folded state and slightly expanded.
Figure 5:
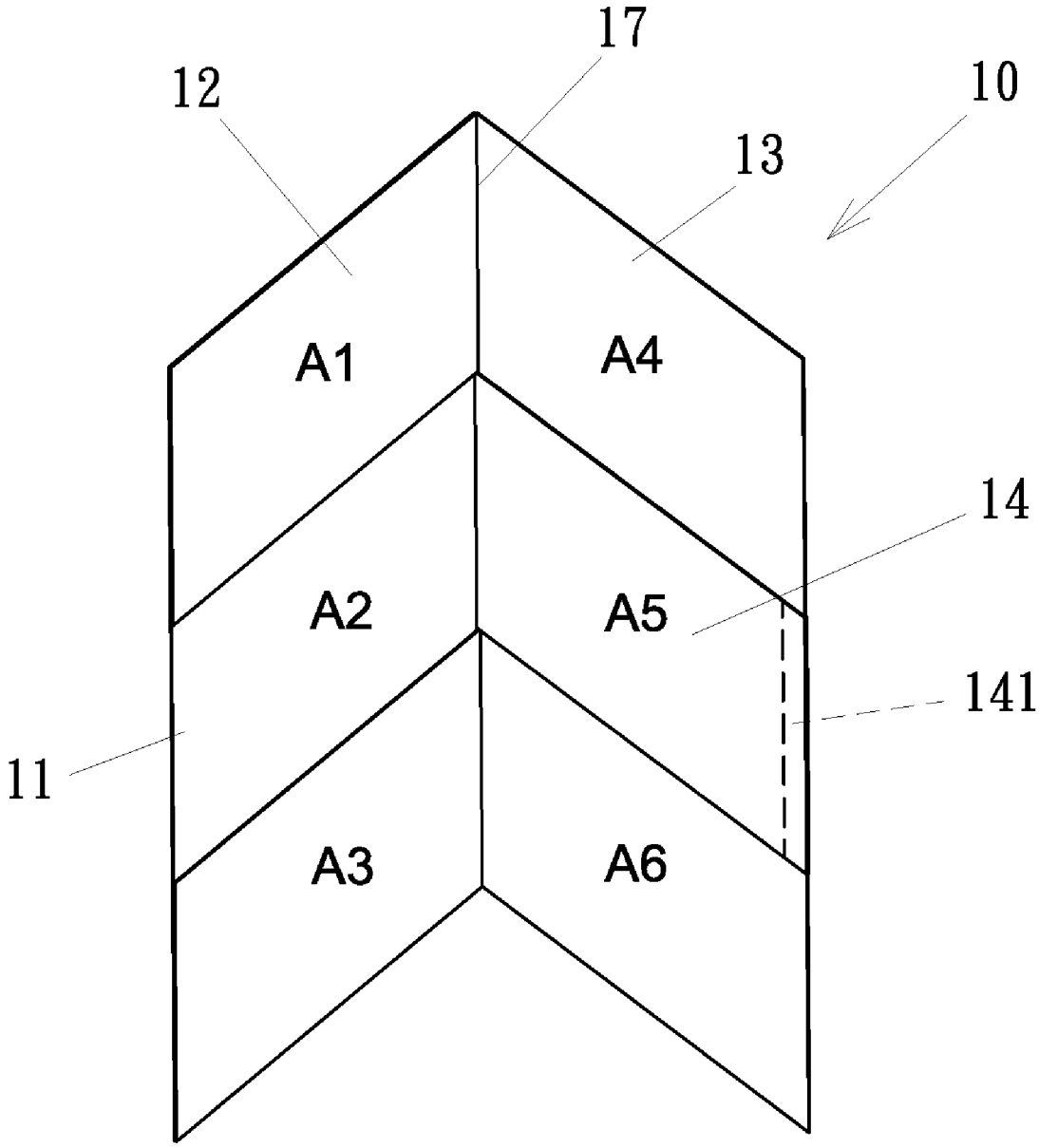
FIG. 5 shows a perspective view illustrating unfolding of the clamping piece of the present invention.
Figure 6:
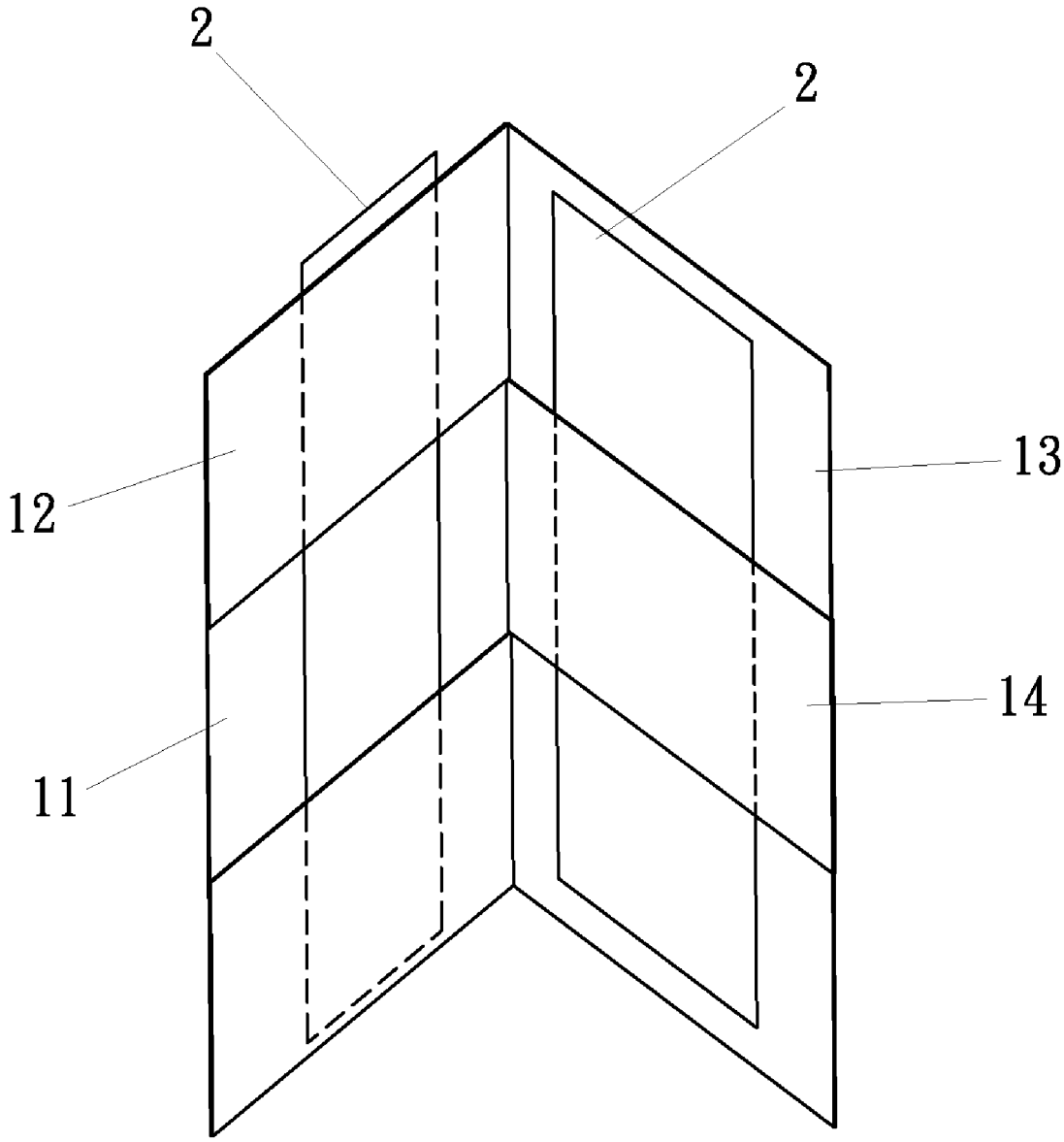
FIG. 6 shows a perspective view illustrating clamping effect of the clamping piece of the present invention.

With reference to FIGS. 4 and 5, wherein FIG. 4 shows the present invention that is slightly expanded after folding. After assembly of the present invention, the first figure portions A1-A6 can be exhibited when the third bending portion 13 is unfolded. In this case, the engagement section 141 of the connecting piece portion 14 is at an outer side of the body 10. Furthermore, objects 2 (such as thin paper or the like) can be clamped between the second and third folding piece portions 12 and 13 and between the first folding piece portion 11 and the connecting piece portion 14, as shown in FIG. 6.

Figure 7:
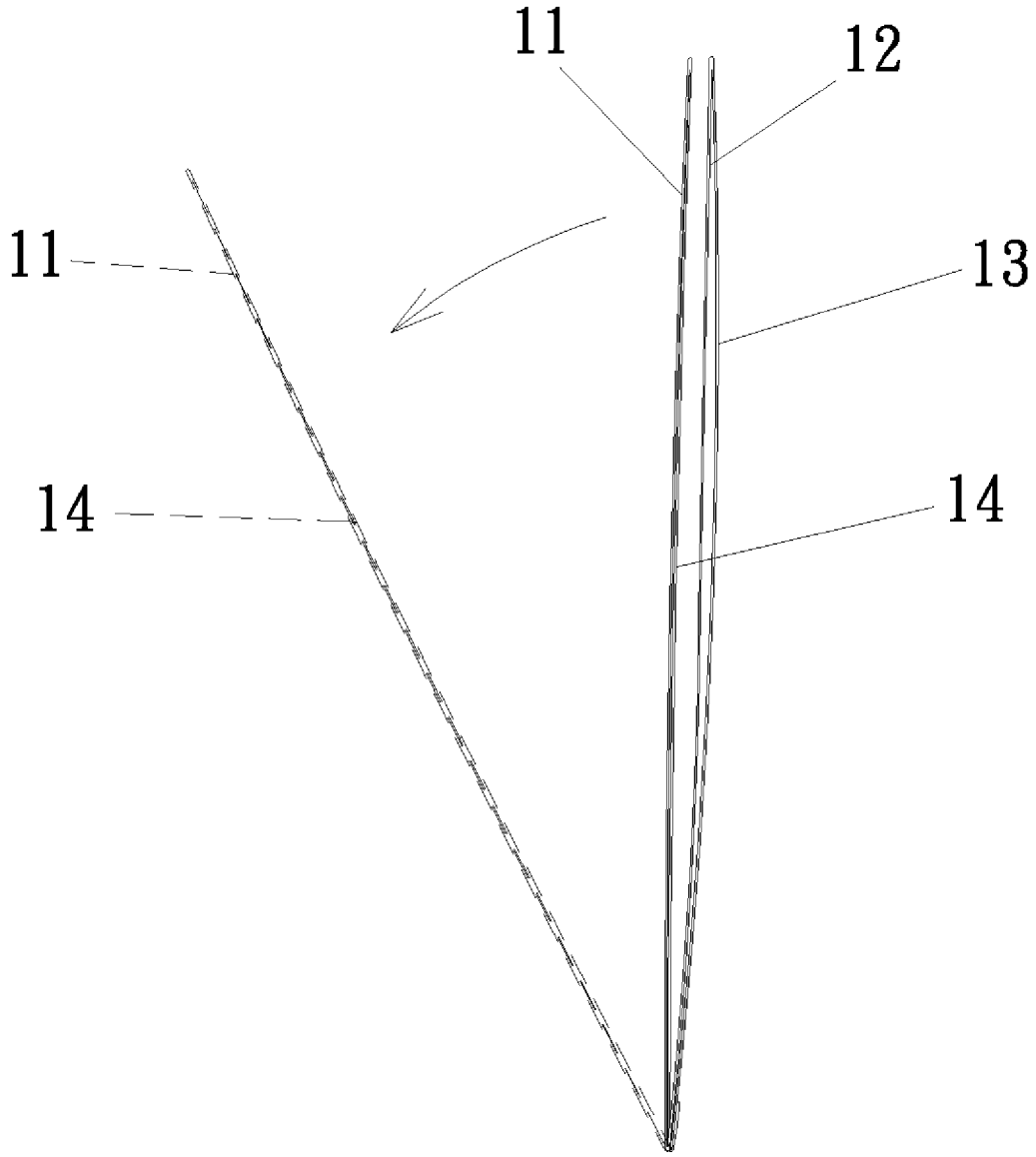
FIG. 7 shows a side view of the clamping piece of the present invention turned in another direction and slightly expanded.
Figure 8:
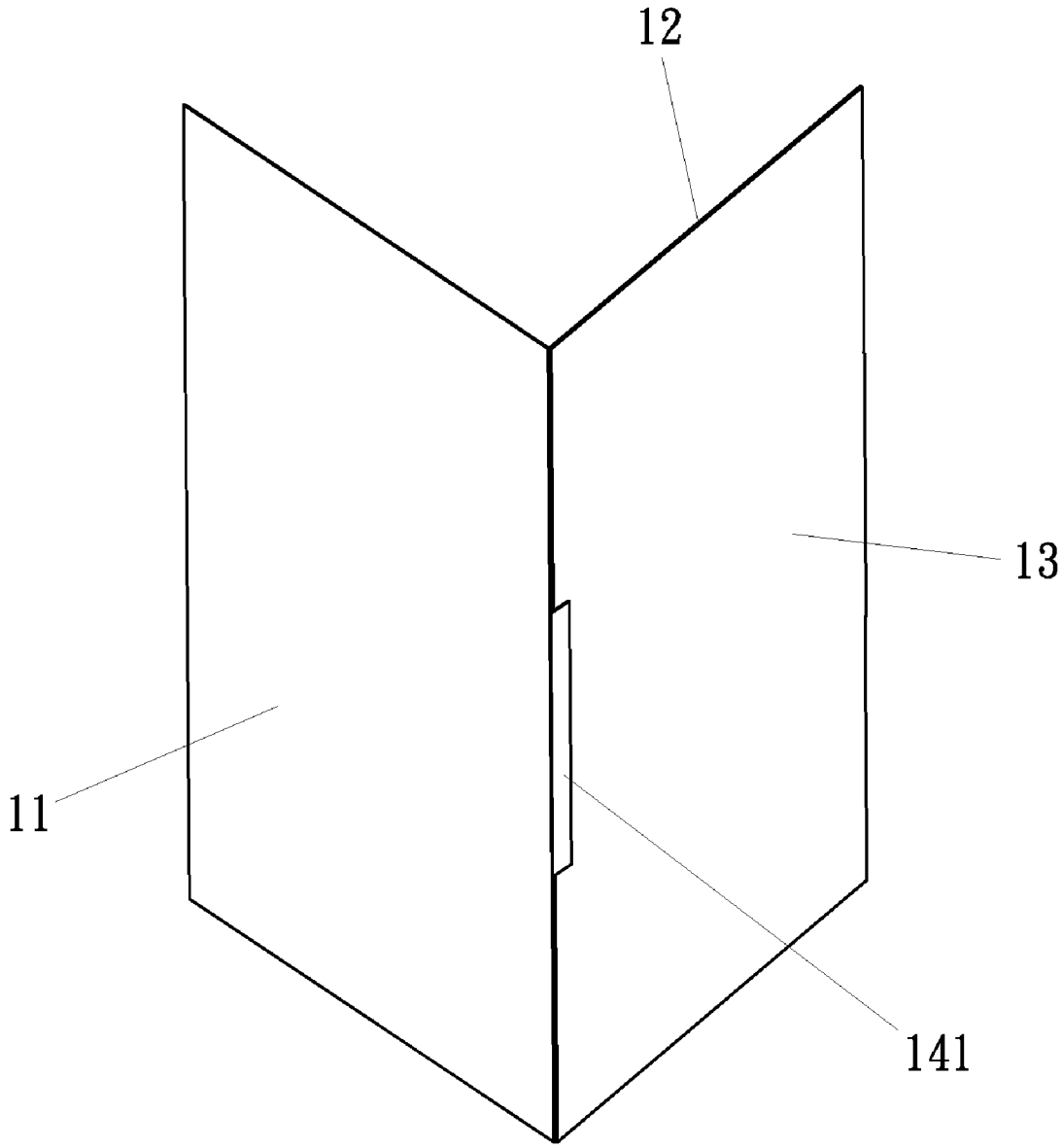
FIG. 8 shows a rear perspective view of the clamping piece of the present invention turned in another direction and unfolded.
Figure 9:
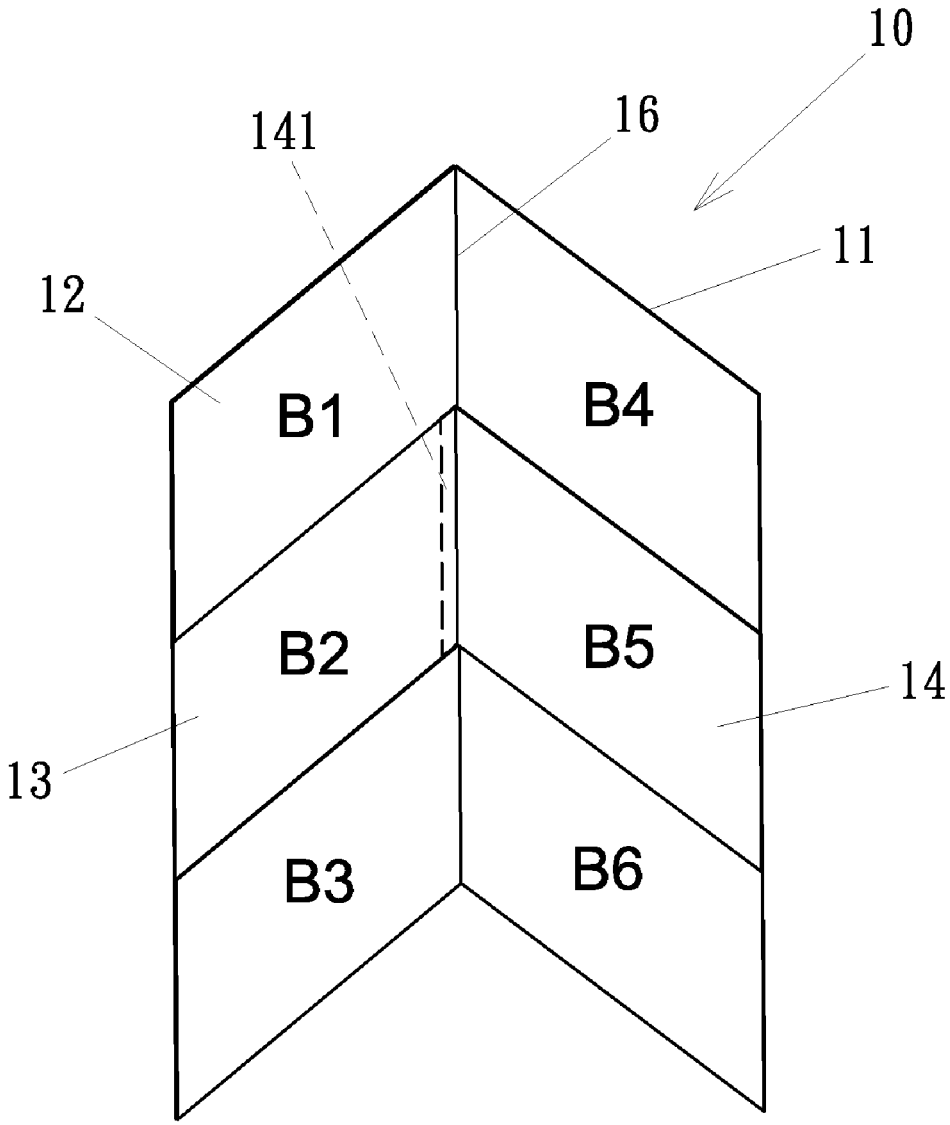
FIG. 9 shows a front perspective view of the clamping piece of the present invention turned in another direction and unfolded.
Figure 10:
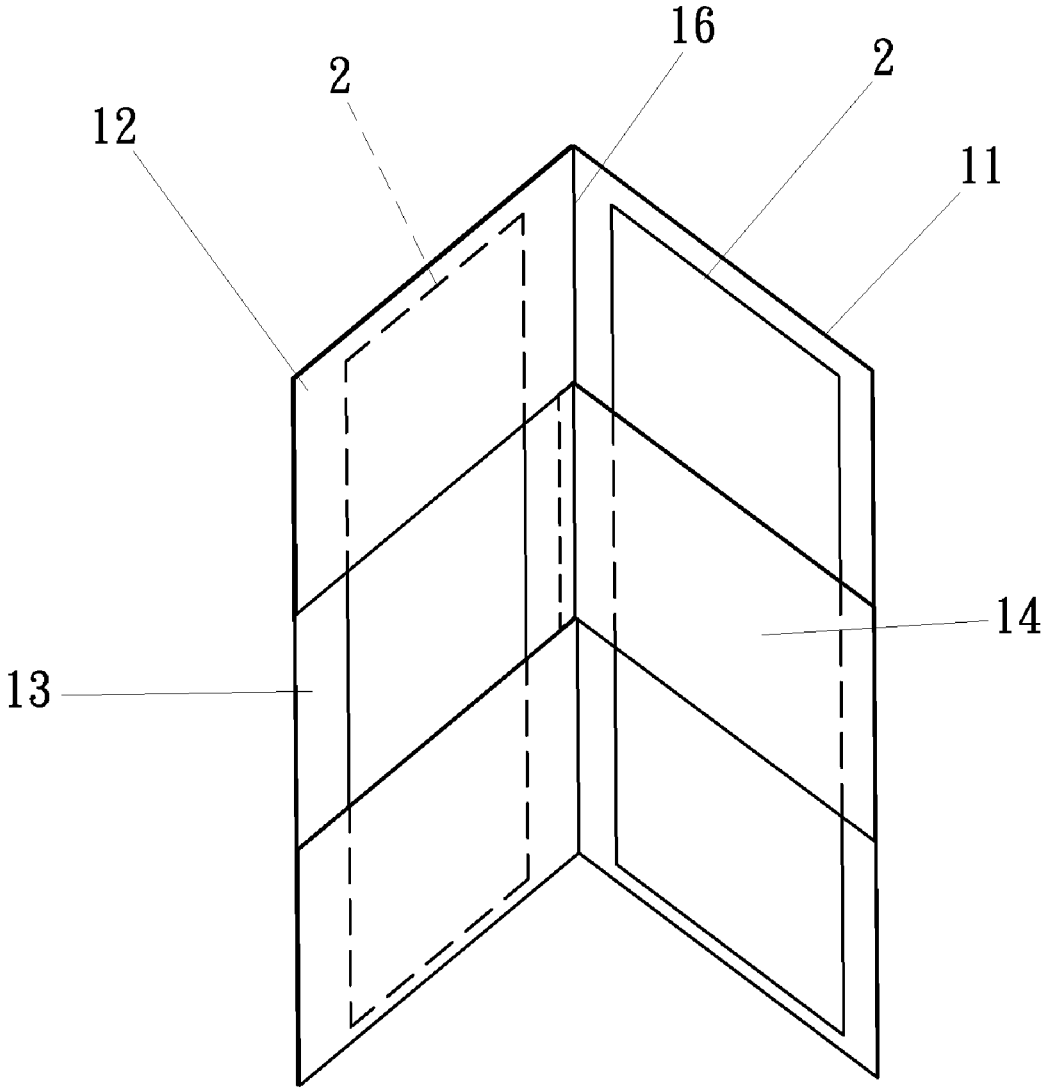
FIG. 10 shows a perspective view of the clamping piece of the present invention turned in another direction and clamping objects.
Figure 11:
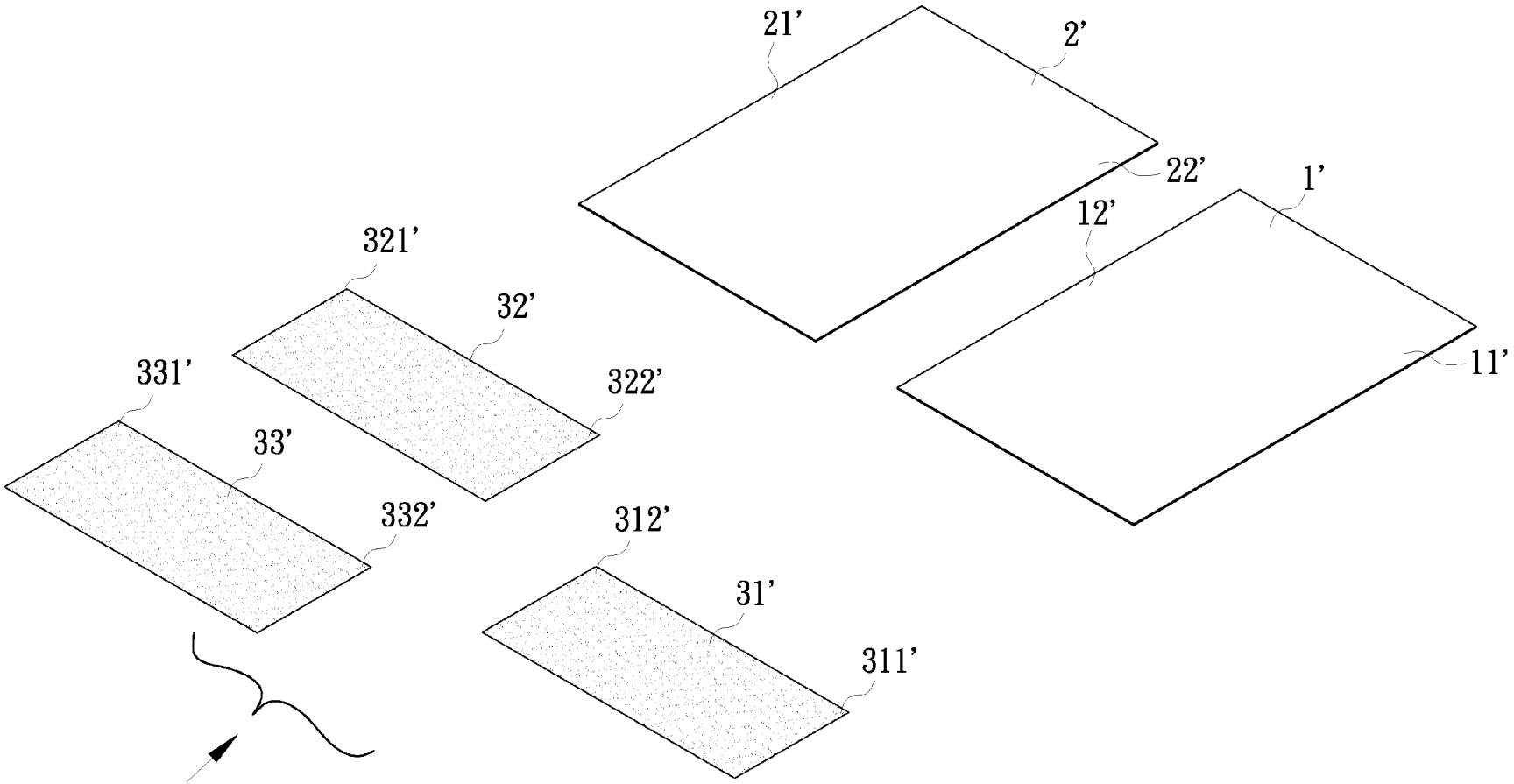
FIG. 11 Prior Art
FIG. 11 shows an exploded, perspective view of a conventional clamping piece.
Figure 12:
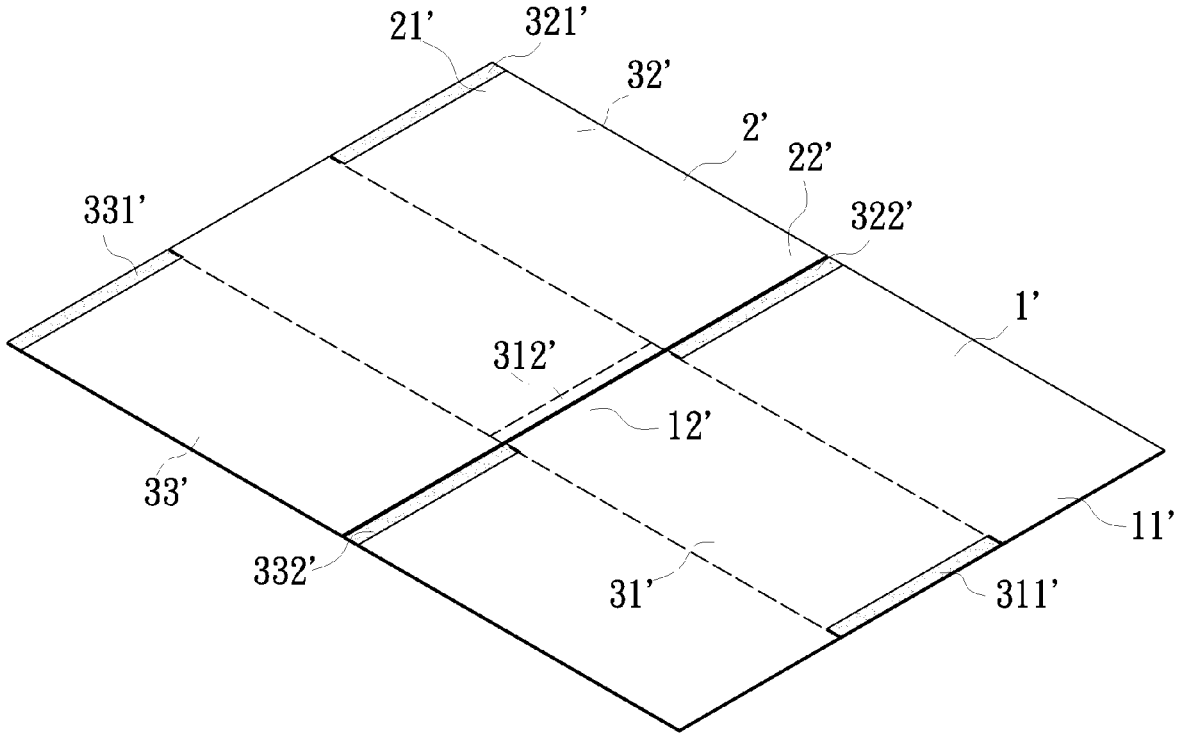
F I G .12 Prior Art
FIG. 12 shows a view of the conventional clamping piece after assembly.
Figure 13:
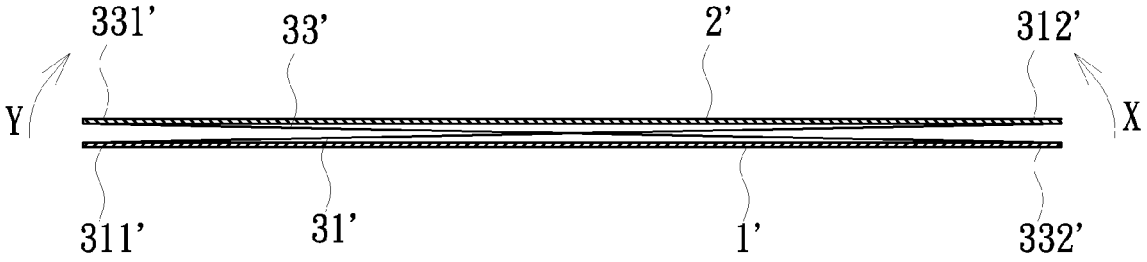
F I G .13 Prior Art
FIG. 13 shows a side view of the conventional clamping piece after assembly.

With reference to FIGS. 7-9, wherein FIG. 7 shows the present invention that is slightly expanded after folding. The present invention can be turned in an opposite direction such that the second figure portions B1-B6 can be exhibited when the second bending portion 12 is unfolded. In this case, the engagement section 141 of the connecting piece portion 14 is at a center of the body 10, as show in FIG. 10. Furthermore, objects 2 can be clamped between the second and third folding piece portions 12 and 13 and between the first folding piece portion 11 and the connecting piece portion 14.

According to the foregoing, the present invention can be turned in differing directions to show different figures or to clamp objects for different visual effects. Furthermore, the present invention is integrally formed to reduce the number of components while providing enhanced assembling convenience and enhanced convenience in figure provision as well as enhanced stability for the produce after assembly. Differing figures can be printed on the inner and outer faces of the body of the present invention such that different visual effects can be obtained when the body is turned. Thus, the present invention can easily be processed and printed, significantly increasing the convenience of printing the figures.

Furthermore, the engagement section of the connecting piece portion and a corresponding position on the third folding piece portion of the present invention can include an engagement member and an engaging hole or buttons for male/female coupling (not shown) to avoid bonding, further enhancing the assembling convenience. The above structure is merely a non-limiting example of the present invention. Equivalent modification according to the present invention is still within the scope of the present invention.

The invention claimed is:

1. A clamping piece structure characterized by comprising a one-piece clamping piece body, with the body including a first folding piece portion, a second folding piece portion, a third folding piece portion, and a connecting piece portion, with the first, second, and third folding piece portions having substantially a same width, with a first bending portion provided at a central section of an edge of the first folding piece portion for interconnection with the connecting piece portion, with a second bending portion provided at another edge of the first folding piece portion for interconnection with the second folding piece portion, with a third bending portion provided at an edge of the second folding piece portion for interconnection with the third folding piece portion, with the connecting piece portion including a main section having a width approximately the same as the width of the first, second, and third folding piece portions, with an opening formed in a central section of the second folding piece portion, with an engagement section provided at an outer edge of the connecting piece portion, with the connecting piece portion insertable through the opening, with a fourth bending portion provided between the engagement section and the main section of the connecting piece portion, with the engagement section of the connecting piece portion engaged with a rear face of the third folding piece portion.

2. The clamping piece structure according to claim 1, characterized in that the engagement section of the connecting piece portion is engaged with the rear face of the third folding piece portion by bonding.

3. The clamping piece structure according to claim 1, characterized in that the connecting piece portion is engaged with the rear face of the third folding piece portion by male/female coupling.

* * * * *